US007412917B2

(12) United States Patent
Vais

(10) Patent No.: US 7,412,917 B2
(45) Date of Patent: Aug. 19, 2008

(54) SOUND SUPPRESSOR SILENCER BAFFLE

(76) Inventor: George Vais, 182 S. Cole Rd., Boise, ID (US) 83709-0932

( * ) Notice: Subject to any disclaimer, the term of this patent is extended or adjusted under 35 U.S.C. 154(b) by 155 days.

(21) Appl. No.: 11/300,149

(22) Filed: Dec. 13, 2005

(65) Prior Publication Data

US 2006/0123983 A1 Jun. 15, 2006

Related U.S. Application Data

(60) Provisional application No. 60/635,323, filed on Dec. 13, 2004.

(51) Int. Cl.
*F41A 21/30* (2006.01)

(52) U.S. Cl. ..... 89/14.4; 181/223

(58) Field of Classification Search ..... 89/14.4, 89/14.3, 14.2, 14.5; 181/223
See application file for complete search history.

(56) References Cited

U.S. PATENT DOCUMENTS

| | | | | | |
|---|---|---|---|---|---|
| 1,770,471 | A * | 7/1930 | Hatcher | ..... | 89/14.3 |
| 1,821,688 | A * | 9/1931 | Bourne | ..... | 181/264 |
| 4,291,610 | A * | 9/1981 | Waiser | ..... | 89/14.4 |
| 4,584,924 | A | 4/1986 | Taguchi | | |
| 4,588,043 | A | 5/1986 | Finn | | |
| 4,939,977 | A * | 7/1990 | Stroup | ..... | 89/14.4 |
| 5,136,923 | A * | 8/1992 | Walsh, Jr. | ..... | 89/14.2 |
| 5,164,535 | A * | 11/1992 | Leasure | ..... | 89/14.4 |
| 6,575,074 | B1 | 6/2003 | Gaddini | | |
| 6,796,214 | B2 * | 9/2004 | Hausken et al. | ..... | 89/14.4 |
| 6,848,538 | B2 * | 2/2005 | Shafer | ..... | 181/223 |
| 6,973,863 | B1 * | 12/2005 | Jones | ..... | 89/14.2 |
| 7,207,258 | B1 * | 4/2007 | Scanlon | ..... | 89/198 |

* cited by examiner

*Primary Examiner*—Michael J. Carone
*Assistant Examiner*—Benjamin P Lee
(74) *Attorney, Agent, or Firm*—Ormiston & McKinney, PLLC

(57) ABSTRACT

A baffle for use in a firearm suppressor, which increases the amount of sound and flash that are perceived upon the firing of a firearm upon which a suppressor is placed without substantial alteration to the power or accuracy of the firearm upon which the suppressor is attached. The baffle is made up of a generally hollow, central core defining open topped tube that is dimensioned so as to allow passage of a projectile through this core. This tube extends from an open front end backwards to an intersection with an inside surface of a rear wall, as well as to an intersection with a forward bulkhead. The bulkhead and the inside surface of the rear wall are located in different vertical and horizontal planes and define expansion chambers and reflection surfaces that alter the escape pattern of gasses out of the suppressor.

11 Claims, 5 Drawing Sheets

SOUND SUPPRESSOR SILENCER BAFFLE

CROSS-REFERENCE TO RELATED APPLICATIONS

This application claims the priority date from the provisional application entitled SOUND SUPPRESSOR BAFFLE filed by the same inventor on Dec. 13, 2004 with application Ser. No. 60/635,323. The contents of which are herein incorporated by reference into the present application.

FIELD OF THE INVENTION

The invention generally relates to sound suppressors for firearms and more particularly to a baffle for use in such a sound suppressor.

BACKGROUND OF THE INVENTION

Sound suppressors for firearms are well known in the prior art and a variety of designs for such devices exist. The aim of a sound suppressor is to reduce the sound that emanates from the firing of a bullet from a firearm. This is typically done in most sound suppressors by reducing the pressure of the propellant gases which immediately follow the projectile out of the end of the firearm. It is the rush of these propellant gasses out of the end of the firearm that cause the loud sound that results from the firing of the gun to occur. By dissipating this pressure under which the gasses escape from the firearm, the amount of sound which is perceived when the gun is fired is significantly reduced. In addition, these devices may also be used to suppress the "flash" which occurs when a bullet is fired from a rifle.

The dissipation of the gasses from the rifle may be achieved in a variety of ways. One way that this may be done is to utilize baffles to deflect the passage of these propellant gases. The prior art includes a variety of complex baffle structures which generally function by allowing partial expansion of the gasses within a chamber that surrounds the core through which a projectile will pass, and then dissipating this gas through the various expansion chambers. Examples of some of these prior art embodiments include the devices shown in the following references: Finn, U.S. Pat. No. 4,588,043, Leasure, U.S. Pat. No. 5,164,535, Taguchi, U.S. Pat. No. 4,584,924, and Gaddini U.S. Pat. No. 6,575,074.

However with the use of a sound suppressor, a variety of other side effects may result which alter the efficacy of the use of the firearm. Some of the problems which exist and which result from the use of a sound suppressor include a loss of power to the projectile which is fired. This loss in power can detrimentally affect the power and trajectory of the projectile which is fired from the firearm, this in turn causes problems related to the accuracy of the firearm with the sound suppressor in place. Furthermore, the structure of some of the prior art suppressor devices are so delicate so as to limit or prevent the use of such devices in various environments. In addition, the particular design of the firearm can have various results related to the quantity of noise which is actually reduced. Some designs simply function to reduce noise better than others.

What is needed and desired therefore is a baffle for use in a sound suppressor that offers high levels of sound reduction, minimizes bullet yaw and enhances, or at the very least, maintains the normal accuracy of the firearm to which the suppressor is attached. The present invention achieves these desired aims.

Accordingly it is an object of this invention to provide a baffle for use in a sound suppressor for a firearm that reduces high levels of sound and flash from the discharge of the firearm yet has little or no detrimental effect on the accuracy of the fired projectile. Additional objects, advantages, and novel features of the invention will be set forth in part in the description as follows, and in part will become apparent to those skilled in the art upon examination of the following, or may be learned by practice of the invention.

SUMMARY OF THE INVENTION

The present invention is a baffle for use in a sound suppressor for a firearm that reduces the sound and flash levels that are typically created when the firearm is discharged. The baffle of the present invention has a novel and unique design which enables the aforementioned aims to be achieved. The baffle of the present invention is made up of a hollow, central core-defining tube which is configured to allow passage of a projectile through the core. The hollow central core defining tube extends from a front end backwards to an intersection with an inside surface of a rear wall. This tube also extends from said front end backward to an intersection, a forward bulkhead; the tube defining a generally longitudinal slot therein. The bulkhead and the inside surface of the rear wall located in different vertical planes. In the preferred embodiment of the invention, this bulkhead and the rear wall of the baffle are connected to a generally circumvolving outer wall which defines an upper and a lower expansion chamber. An elongated slot defined within the rear wall allows passage of same material through the rear wall. These expansion areas allow for expansion of gasses after the firing of a firearm and the surfaces within these chambers provide surfaces upon which reflection of this energy can take place. The interaction of the propellant gasses against these surfaces causes these propellant gasses to hit, divide, be redirected and channeled in a way that greatly reduces the amount of noise that is perceived by a user upon the firing of a gun.

In practice, the disclosed baffle is positioned within a sound suppressor housing that is attached to the muzzle of a firearm. This connection may be achieved by any of a number of known means for connection including but not limited to the inclusion of a screw thread or a quick-attach system, slotted connections or any other number of other attachment methods which are known to persons of skill in the art. The device is attached in such a way so as to provide an elongated path for the projectile through the baffles. When discharge of the firearm occurs, the projectile exits from the barrel and traverses the suppressor passing through the bore. The gases behind the projectile enter the suppressor and expand within the expansion chamber positioned near the first end of the suppressor. As the gasses move forward towards the first baffle, gases flow forward into the lower expansion area and impinge upon the rear surface of the bulkhead wall. This causes the gasses to be reflected and to rise upward from the lower expansion area. The position of the tube between the upper and lower chambers causes these gasses to have to divide around this tube. As these gasses divide, they separate and then after contacting another surface within the device, are redirected and reflected back towards the center axis. Here in order to escape from this chamber, the gasses must pass into the next chamber through the aperture defined within the rear wall. The position of this aperture in the lower portion of the rear wall causes gasses to exhaust into the lower chamber where they expand, rise, are divided and reflected back towards the center from opposite directions. These gasses then are directed toward and pass through the rear wall and into the next chamber where the same process takes place again. This process of expanding and reflecting causes the pressure and velocity of the gasses to be divided and redirected. This continues to take place until the gases exit the suppressor with a reduced pressure and velocity, which results in a subsequent reduction in the sound level due to the reduced pressure and velocity of the muzzle gases.

The structure of the present invention redirects gasses in a way whereby a sufficient quantity of gas traveling behind the projectile is maintained so as to minimize any decrease in power or accuracy while at the same time dissipating sufficient energy so as to significantly reduce the quantity of noise and flash that occurs with the discharge of the firearm, as compared to other sound suppressors which exist in the prior art.

The purpose of the foregoing summary description is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention, which is measured by the claims, nor is it intended to be limiting as to the scope of the invention in any way.

Still other features and advantages of the present invention will become readily apparent to those skilled in this art from the following detailed description describing only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
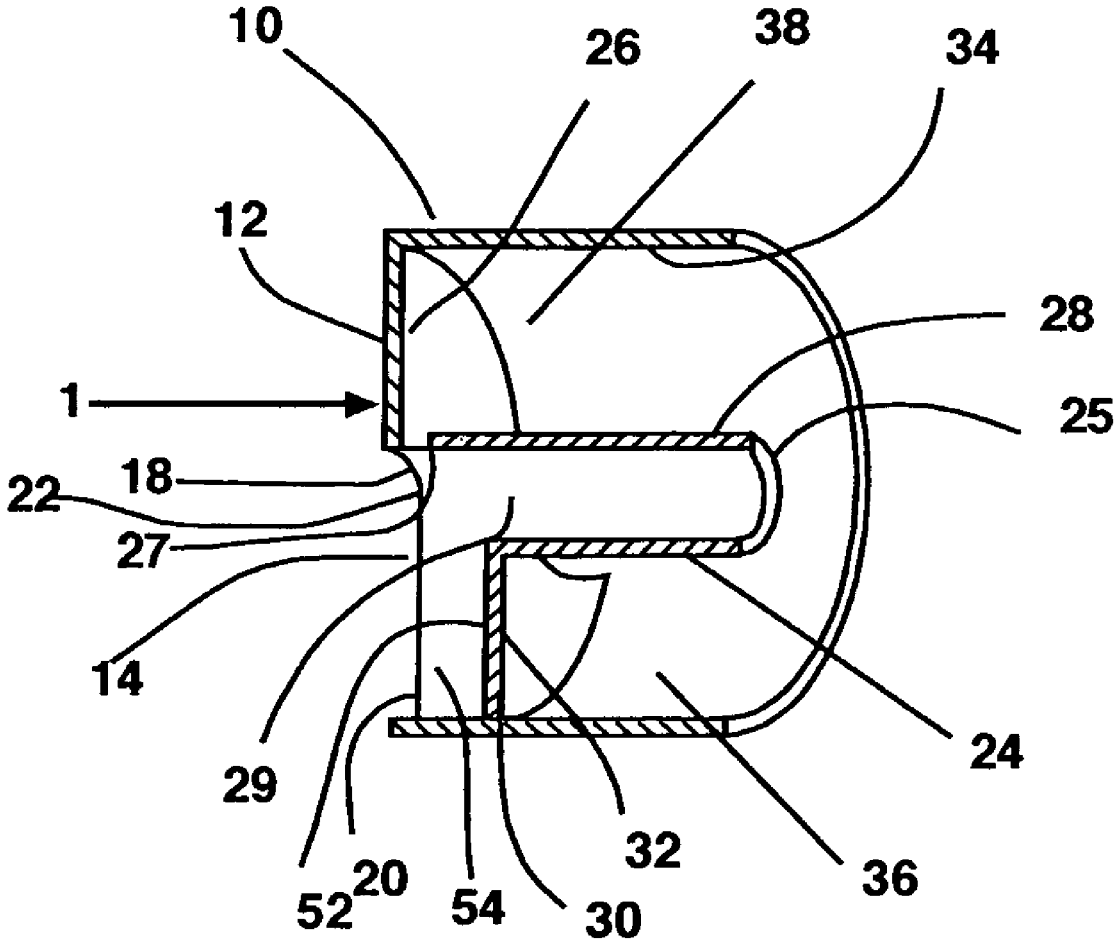
FIG. 1 is a sectional view of the baffle, showing the baffle cut in half.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

FIGS. 1-4 show various views of the preferred embodiment of the present invention. FIG. 5 shows a cut away view of the baffles of the present invention in use within a housing. Referring first to FIG. 1. FIG. 1 is a cut away cross-sectional view of the baffle 1 of the present invention showing this baffle being cut in half. The baffle 1 of the present invention is comprised of a central core defining tube 24 that extends from a front end 25 backwards to an intersection 27 with the inside surface 26 of a rear wall 12 as well as to an intersection 29 with a forward bulkhead 30. The location of the intersections 27, 29 are in different vertical and horizontal planes. This central core defining tube 24 contains a longitudinal slot 28 that extends along the top portion of the central core 24 to intersection 27 of the central core defining tube with the inside surface 26 of the rear wall 12. The inside surface of the rear wall 26 and the rear face 52 of the bulkhead define an underslot cavity 54.

In the present embodiment of the invention, these baffles are positioned within a device which contains an outer wall 10. In the pictured embodiment of the invention this outer wall 10 is integrally formed with the baffle 1 and the baffle and the inner surface 34 of this outer wall 10 are combined together. However, it is to be understood that the baffles 1 of the invention may also be otherwise included within a housing or other device which provides such an outer wall 10 and more particularly an inner surface 34 of this outer wall. In the demonstrated embodiment of the invention the baffles 1 are integrally formed with a generally hollow cylinder which contains an outer wall 10 having an inner surface 34. The front bulkhead 30 extends between the intersection 29 of the front bulkhead and the core defining tube 24. This front bulkhead 30 provides support and mechanical integrity to the approximately bottom one-third surface area of the central core defining tube 24. This bulkhead also provides a front surface 32 which assists to reflect gasses within the housing of the cylinder. The inside surface 26 of the rear wall interconnects a portion of the core defining tube 24 to the inner surface 34 of the outer wall 10. This inside surface 26 of the rear wall 12 also provides a surface for the reflection of gasses.

The rear wall 12 defines an opening 14 or slot which extends from a first end 18 which is generally centrally located so as to define a bore opening 22 downward to a second end 20. This slot is configured to extend in a generally downward direction in back of the front bulkhead 30. This front bulkhead 30 has a rear face 52 which is positioned a desired and designated distance in back of the rear face 12. The depth of this elongated opening 14 is determined by the distance of the rear wall or bulkhead 30 from the rear face 12 of the baffle 1.

The interior surface 34, the forward bulkhead 30, and the inner surface of the rear wall 26 define two main expansion areas, a lower expansion 36 located below the core defining tube 24, and an upper expansion area 38 located above the upper expansion area. These chambers are connected together and defined by the central core defining tube 24.

Figure 2:
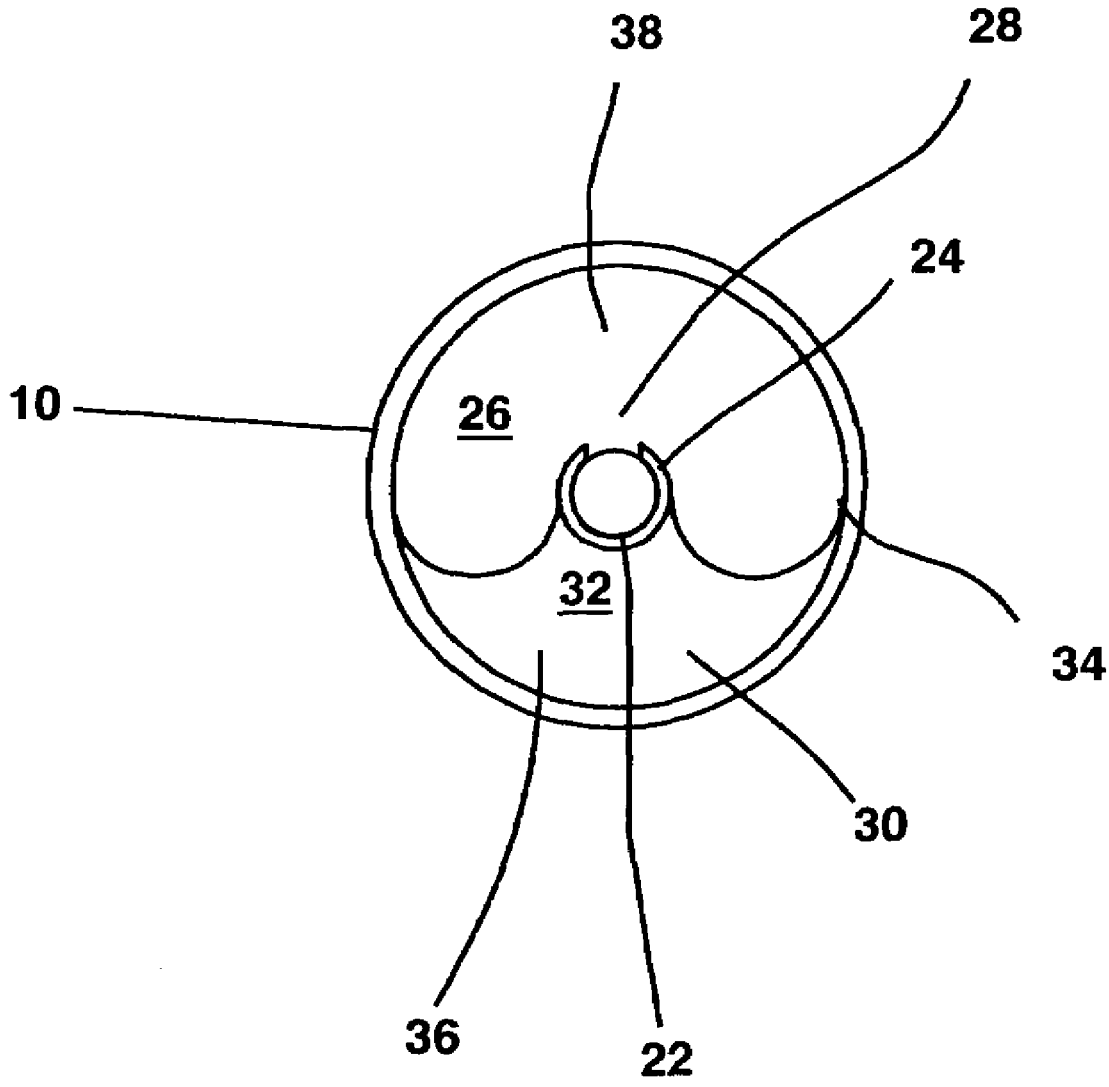
FIG. 2 is front view of the baffle shown in FIG. 1.
Figure 3:
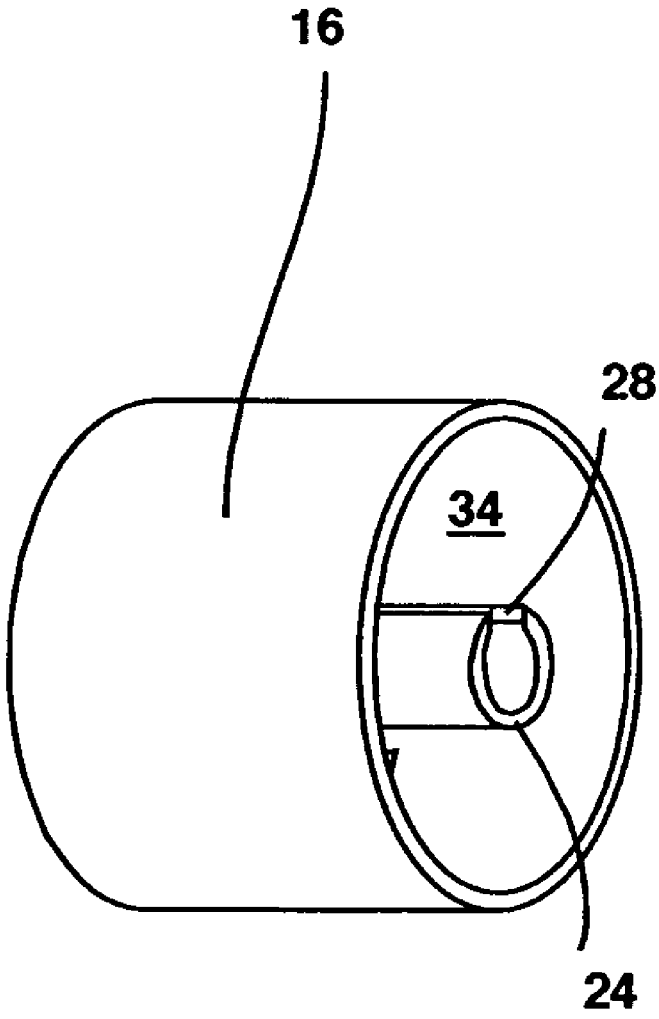
FIG. 3 is a perspective front view of the preferred embodiment of the baffle section of the present invention.

FIG. 2 is a front view of the baffle 1 shown in FIG. 1. The central core defining tube 24 is shown with the longitudinal slot 28. The width of this slot 28 is slightly less than the internal diameter of the central core defining tube 24. FIG. 3 shows the shape of the front face 32 of the bulkhead 30 more clearly as well as the inner surface 26 of the rear wall. These items together define the upper and lower expansion areas 36,38. It should be realized that while the shape of the bulkhead 30 is shown to be generally curved in shape that this particular configuration is so embodied for ease of manufacture and that other geometrical shapes may also be used. It should also be readily recognized that removal of an additional portion of the front surface 32 of the bulkhead will decrease the overall weight of the baffle and the suppressor, and will increase the capacity of this lower expansion area 36.

FIG. 3 is a front perspective view of the cylinder 2 and baffle 1 described above. In this view, the longitudinal slot 28 in the central core defining tube 24 and its position in the central core 24 is more clearly shown. The central core defining tube 24 as shown in FIG. 4 does not protrude past the front of the cylinder 2 and the wall thickness of the central core is sufficient to provide strength but is not excessive.

Figure 4:
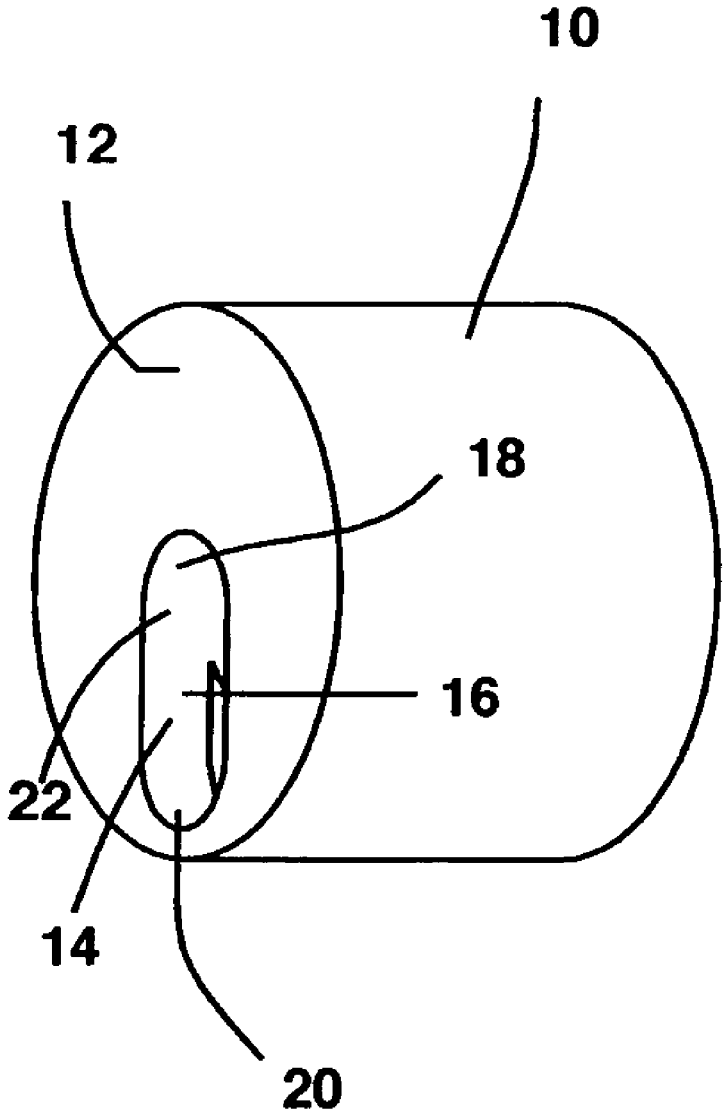
FIG. 4 is a rear perspective view of the baffle, also showing the gas entry area of the embodiment.
Figure 5:
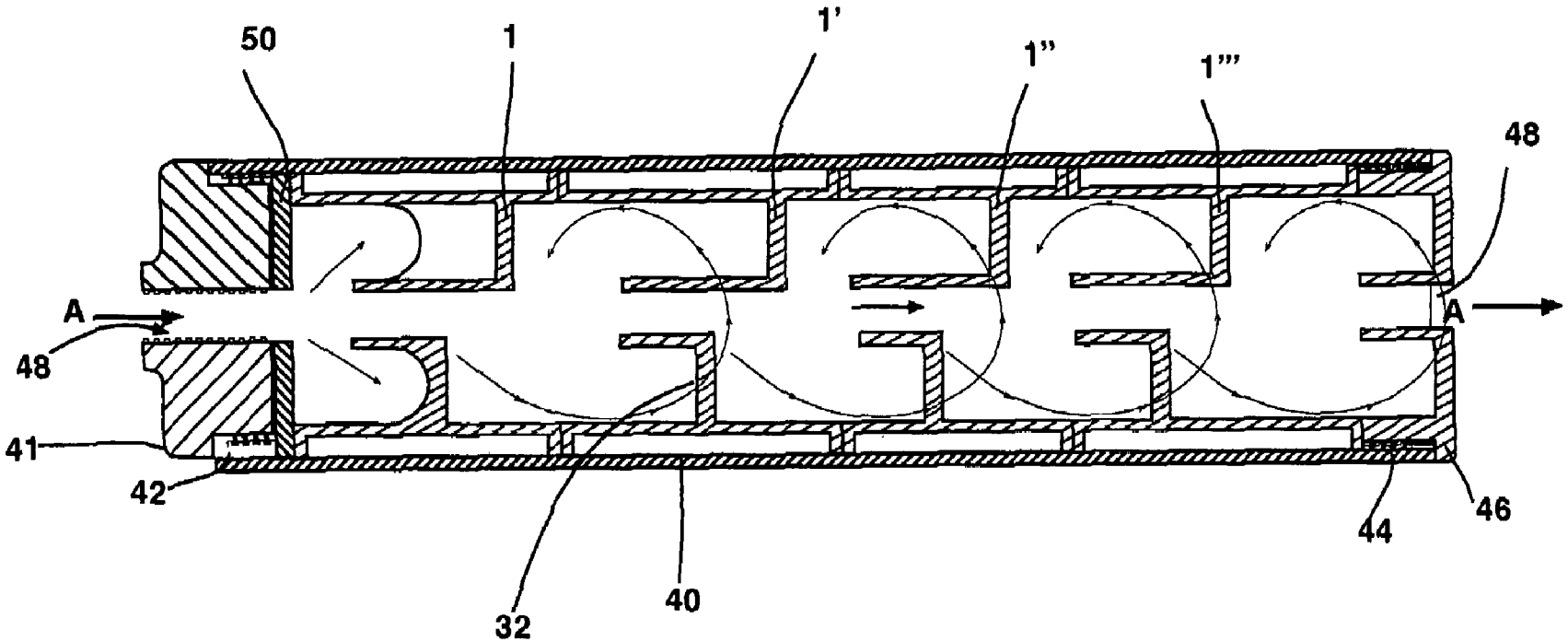
FIG. 5 is a cut away side view of a housing containing a plurality of the baffles of the present invention in use.

FIG. 4 shows a rear perspective view of the baffle portion of the present invention in its most easily manufacturable form. The baffle 1 of the present invention has an outer wall 10 with a generally flat face 12, which defines an elongated opening 14, through which gasses will pass. This elongated opening 14, as is shown, extends generally downward from the center axis A of the baffle 1. The elongated opening 14 consists of a slot 16 with two round ends 18 and 20 respectively. In practice, only the first end 18 of the elongated opening 14 needs to be rounded, as this is part of the bore aperture 22 which is configured and defined in such a way so as to allow a projectile to pass through the baffle 1. The second end 20 may also be generally rounded or may be any other general shape. In general terms, the width of the elongated opening 14 is determined by the width of the bore aperture 22.

FIG. 5 shows a cut-away side view of the baffles of the present invention in a proposed use. In use, the baffles of the present invention are arranged in a generally linear interconnecting series within a housing 40. Such a housing 40 is typically comprised of a generally hollow body 40 with an end cap 42 near its first end 41. A portion of the first end or end cap is generally configured to connect and attach to a portion of a firearm. Preferably, at least one Belleville spring 50 is positioned between a portion of the housing near the first end 41 of the device and the attachment portion of the firearm so as to prevent the loosening of the connection between the housing 40 and the firearm. The second end 44 of the housing is connected to a second end cap 46. The first and second end caps 42, 46 define apertures 48 that are positioned and aligned with the discharge end of the firearm 100 and the central core defining tube 24 of the baffles 1, 1', 1", 1'" so as to define a passageway through which a projectile may travel. In the preferred embodiment of the invention this passageway is aligned with the central axis A of the housing and the baffles.

While in the configuration shown in FIG. 5, the housing 40 is dimensioned so as to be sufficiently larger than the cylinders described so as to create a second set of chambers and thus render this example a double chambered silencer or suppressor, it is to be distinctly understood that the invention is not limited to use in such an embodiment but may be variously embodied to include a variety of other types of devices as well. In addition in some configurations apertures may be located within the walls of the baffles which allow gas to escape into the space between the baffles and the housing.

In use, the discharge of a projectile from the firearm 100 causes this projectile to travel through the passageway defined by the baffles. As is shown in FIG. 5, when this occurs, the gases which are in back of and which propel the projectile forward, enter into the sound suppressor and expand. These gasses are moving in a general forward direction and are reflected off of the first surfaces, back toward the firearm itself. The asymmetrical planar positioning of the inside surface of the rear wall and the front face of the bulkhead cause these gasses to travel in a general circular pathway back against the direction in which they were originally traveling. These gasses then rise upward, are split by the core defining tube and enter into the upper expansion chamber. In this upper expansion chamber, these gasses are again reflected downward toward the slotted opening in the top of the core defining tube; as these gasses enter this tube the build up pressure behind these gasses force these gasses toward the next baffle. The velocity of the gas reduces and the chamber pressurizes until the gas, which naturally seeks the path of least resistance, escapes pass the baffle by passing through the elongated slot that is defined in the rearwall. When this occurs, this gas continues to move forward into the next section, where it expands and is reflected by the next baffle in the series, and the same process ensues. This action of reflecting gasses back and forth throughout the chamber causes the velocity of the gasses to be reduced because of the opposing interactions that take place between the various trajectories of the propellant gas. By the time that this has taken place however, sufficient dissipation of noise and flash has taken place. While in most instances between 2 and 5 baffles are typically required to achieve and produce the desired result, the number and dimensions of these baffles may be altered depending upon the individual circumstances.

In the preferred embodiment of the invention, the baffles are configured to define chambers that each has a volume between 1.25 to 3 times the volume of the bore. The number of baffles and the lengths of the expansion chambers within these baffles may be altered so as to maximize the cancellation of gas pressure within these expansion areas. In one preferred embodiment, the length of the baffles and the diameter of the bore decreases as the device moves away from the first end of the housing. However, in other embodiments of the invention, these baffles may be configured to be substantially uniform as is shown in FIG. 5.

While the following descriptions of the present invention are shown, it should be recognized that the dimensions of baffle 1 will vary according to the caliber of the firearm used. Depending upon the caliber of the gun upon which the device is attached and the gas pressure characteristics of the gun and the rounds being fired, the length of the baffle may vary considerably. In practice it has been found that larger caliber firearms require the length of the baffles to be longer in comparison to smaller caliber firearms, even though some smaller caliber firearms have muzzle gas pressures close to those of some larger caliber firearms. The spacing between baffles has also been found to vary considerably. In practice it has been found that for optimum noise reduction with various calibers, that the spacing of the baffles is of a fixed nature, i.e. the distance between baffles is of a fixed length throughout the suppressor. With other calibers, it has been found that for optimum noise reduction that varying the length of the chambers defined between the baffles provides superior noise reduction. It has been shown to be particularly effective to shorten the distance between baffles towards the muzzle of the suppressor. It has also been found in practice that the depth of the elongated opening on the rear face, and thus the dimensions of the underslot cavity may also be modified according to the caliber and gas pressure characteristics of the firearms and projectiles being utilized.

When used in a suppressor, the disclosed baffle provides high sound reduction levels with a minimal effect on accuracy. The central core provides a passageway for the projectile to pass through that is relatively clear of gas cross flow (gases flowing across the bore line of the baffle) while the projectile is passing through the baffle. The gases flow forward into the lower chamber that is below the bore line or axis and then rise up and forward to the front of the baffle. Directing the gases away from the longitudinal axis of the suppressor enhances the level of sound reduction.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A firearm suppressor baffle comprising a tube, a forward bulkhead, and a rear wall; wherein:

the tube defines a longitudinal axis along which a projectile can pass through the baffle, the tube has a first end for receiving the projectile and a second end through which the projectile exits, a first side of the tube extends a first distance from the first end to an intersection of the tube with the forward bulkhead, a second side of the tube extends a second distance from the first end to an intersection of the tube with the rear wall, the second distance is greater than the first distance;

a longitudinal slot extends from the first end of the tube to the intersection of the tube with the rear wall;

the forward bulkhead occupies a first plane oriented generally orthogonal to the longitudinal axis, the forward bulkhead includes opposing front and opposing rear surfaces that extend radially outward along a first partial circumference of the tube; and the rear wall occupies a second plane oriented generally orthogonal to the longitudinal axis, the rear wall including opposing front and rear surfaces that extend radially outward along a second partial circumference of the tube, the second plane being different than the first plane.

2. The baffle of claim 1, wherein the first partial circumference is less than the second partial circumference so that a surface area of the front surface of the forward bulkhead is less than a surface area of the surface of the rear wall.

3. The baffle of claim 1, wherein the rear surface of the forward bulkhead, the rear surface of the rear wall, and the second end of the tube define an under slot cavity positioned between the first and second planes.

4. The baffle of claim 1, wherein the baffle is configured to be positioned within a generally hollow body so as to define a first expansion area adjacent to the rear wall between an inner wall of the hollow body and the tube and a second expansion area adjacent to the forward bulkhead between an inner wall of the hollow body and the tube.

5. The baffle of claim 4, wherein the a volume of the first expansion area is greater than a volume of the second expansion area.

6. A firearm suppressor, comprising a generally hollow housing and a plurality of baffles, the hollow housing having a longitudinal axis passing from a first end to a second end and along which a projectile can pass through the suppressor, each baffle includes a tube, a forward bulkhead, and a rear wall, and wherein for each baffle:

the tube defines the longitudinal axis along which the projectile can pass through the baffle, the tube has a first end for receiving the projectile and a second end through which the projectile exits, a first side of the tube extends a first distance from the first end to an intersection of the tube with the forward bulkhead, a second side of the tube extends a second distance from the first end to an intersection of the tube with the rear wall, the second distance is greater than the first distance;

a longitudinal slot extends from the first end of the tube to the intersection of the tube with the rear wall;

the forward bulkhead occupies a first plane oriented generally orthogonal to the longitudinal axis, the forward bulkhead including opposing front and opposing rear surfaces that extend radially outward along a first partial circumference of the tube; and the rear wall occupies a second plane oriented generally orthogonal to the longitudinal axis, the rear wall including opposing front and rear surfaces that extend radially outward along a second partial circumference of the tube, the second plane being different than the first plane.

7. The suppressor of claim 6, wherein, for each baffle, the first partial circumference is less than the second partial circumference so that a surface area of the front surface of the forward bulkhead is less than a surface area of the surface of the rear wall.

8. The suppressor of claim 6, wherein, for each baffle, the rear surface of the forward bulkhead, the rear surface of the rear wall, and the second end of the tube define an under slot cavity positioned between the first and second planes.

9. The suppressor of claim 6, wherein, for each baffle, the baffle is configured to be positioned within a generally hollow body so as to define a first expansion area adjacent to the rear wall between an inner wall of the hollow body and the tube and a second expansion area adjacent to the forward bulkhead between an inner wall of the hollow body and the tube.

10. The suppressor of claim 9, wherein, for each baffle, the a volume of the first expansion area is greater than a volume of the second expansion area.

11. The Suppressor of claim 6 further comprising a belleville spring positioned along the longitudinal axis between the first end of the hollow housing and the plurality of baffles.

* * * * *

UNITED STATES PATENT AND TRADEMARK OFFICE

CERTIFICATE OF CORRECTION

PATENT NO. : 7,412,917 B2
APPLICATION NO. : 11/300149
DATED : August 19, 2008
INVENTOR(S) : George Vais It is certified that error appears in the above-identified patent and that said Letters Patent is hereby corrected as shown below:

In Claim 1:

Column 7, line 7 before “side” insert --longitudinal--
Column 7, line 9 before “side” insert --longitudinal--
Column 7, line 13, after “slot” insert --in the tube--
Column 7, line 17, after “and” delete “opposing”
Column 7, line 24 after “tube” insert --substantially opposite to the first partial circumference,--

In Claim 6:

Column 8, line 4, after “first” insert --longitudinal--
Column 8, line 6, after “second” insert --longitudinal--
Column 8, line 10, after “slot” insert --in the tube--
Column 8, line 14, after “and” delete “opposing”
Column 8, line 21, after “tube” insert --substantially opposite to the first partial circumference,--

Signed and Sealed this

Twenty-fifth Day of November, 2008

JON W. DUDAS
*Director of the United States Patent and Trademark Office*